US009428916B2

(12) United States Patent
Railkar et al.

(10) Patent No.: US 9,428,916 B2
(45) Date of Patent: Aug. 30, 2016

(54) MESH VENT WITH VARYING DENSITY OR INTEGRAL MOISTURE BARRIER

(71) Applicant: Building Materials Investment Corporation, Dallas, TX (US)

(72) Inventors: Sudhir Railkar, Wayne, NJ (US); Adem Chich, Kearny, NJ (US); Walter Zarate, Prospect Place, NJ (US)

(73) Assignee: Building Materials Investment Corporation, Dallas, TX (US)

( * ) Notice: Subject to any disclaimer, the term of this patent is extended or adjusted under 35 U.S.C. 154(b) by 828 days.

(21) Appl. No.: 13/721,940

(22) Filed: Dec. 20, 2012

(65) Prior Publication Data

US 2013/0165038 A1 Jun. 27, 2013

Related U.S. Application Data

(60) Provisional application No. 61/580,453, filed on Dec. 27, 2011.

(51) Int. Cl.
*E04D 13/17* (2006.01)

(52) U.S. Cl.
CPC ..... *E04D 13/176* (2013.01)

(58) Field of Classification Search
CPC ..... E04D 13/17; E04D 13/176; F24F 7/02
USPC ..... 454/364, 365, 50, 160
See application file for complete search history.

(56) References Cited

U.S. PATENT DOCUMENTS 2,388,759 A 11/1945 Moore
3,236,170 A 2/1966 Meyer et al.
3,303,773 A 2/1967 Smith et al.
3,949,657 A 4/1976 Sells
4,325,290 A 4/1982 Wolfert
4,803,813 A 2/1989 Fiterman
4,843,953 A 7/1989 Sells
4,876,950 A 10/1989 Rudeen
4,924,761 A 5/1990 MacLeod et al.
4,942,699 A 7/1990 Spinelli
5,009,149 A 4/1991 MacLeod et al.
5,054,254 A 10/1991 Sells
5,092,225 A 3/1992 Sells
5,094,041 A 3/1992 Kasner et al.
5,122,095 A 6/1992 Wolfert (Continued)

OTHER PUBLICATIONS

Trimline Building Products, website printout, 2 pages, www.trimline-products.com.

(Continued)

*Primary Examiner* — Gregory Huson
*Assistant Examiner* — Dana Tighe
(74) *Attorney, Agent, or Firm* — Womble Carlyle Sandridge & Rice LLP

(57) ABSTRACT

A mesh ridge vent has an air permeable layer formed of randomly aligned synthetic fibers that are opened and blended, randomly aligned into a web by airflow, joined by phenolic or latex binding agents, and heat cured to produce an air-permeable varying mesh. A moisture barrier may be integrally formed above the air permeable layer and may be defined by a coating or by a layer of fibers that is sufficiently dense to inhibit penetration of water into the web. The mesh ridge vent has edge portions and a central portion and the edge portions may be more dense and thicker while the central portion may be less dense and thinner than the edge portions.

11 Claims, 3 Drawing Sheets

(56) References Cited

U.S. PATENT DOCUMENTS

| | | | | |
|---|---|---|---|---|
| 5,149,301 | A | 9/1992 | Gates | |
| 5,167,579 | A * | 12/1992 | Rotter | E04D 1/36 454/365 |
| 5,174,076 | A | 12/1992 | Schiedegger et al. | |
| 5,288,269 | A | 2/1994 | Hansen | |
| 5,304,095 | A | 4/1994 | Morris | |
| 5,326,318 | A | 7/1994 | Rotter | |
| 5,328,407 | A | 7/1994 | Sells | |
| 5,425,672 | A | 6/1995 | Rotter | |
| 5,458,538 | A | 10/1995 | MacLeod et al. | |
| 5,561,953 | A | 10/1996 | Rotter | |
| 5,651,734 | A | 7/1997 | Morris | |
| 5,673,521 | A | 10/1997 | Coulton et al. | |
| 5,676,597 | A * | 10/1997 | Bettoli | E04D 1/30 454/365 |
| 5,704,834 | A * | 1/1998 | Sells | F24F 7/02 454/365 |
| 5,826,383 | A | 10/1998 | Garrison | |
| 5,830,059 | A | 11/1998 | Sells | |
| 5,902,432 | A | 5/1999 | Coulton et al. | |
| 5,947,817 | A | 9/1999 | Morris et al. | |
| 5,960,595 | A | 10/1999 | McCorsley, III et al. | |
| 6,015,343 | A | 1/2000 | Castillo et al. | |
| 6,077,159 | A | 6/2000 | Clayton | |
| 6,149,517 | A | 11/2000 | Hansen | |
| 6,213,868 | B1 | 4/2001 | Sells | |
| 6,298,613 | B1 | 10/2001 | Coulton et al. | |
| 6,308,472 | B1 | 10/2001 | Coulton et al. | |
| 6,343,985 | B1 * | 2/2002 | Smith | E04D 13/176 454/365 |
| 6,418,678 | B2 | 7/2002 | Rotter | |
| 6,450,882 | B1 | 9/2002 | Morris et al. | |
| 6,598,356 | B1 | 7/2003 | Sells | |
| 6,773,342 | B2 | 8/2004 | Rotter | |
| 6,981,916 | B2 | 1/2006 | Coulton | |
| 7,182,688 | B2 | 2/2007 | Coulton | |
| 7,222,463 | B2 | 5/2007 | Rotter | |
| 7,384,331 | B2 | 6/2008 | Coulton | |
| 7,393,273 | B2 | 7/2008 | Ehrman et al. | |
| 7,422,520 | B2 | 9/2008 | Coulton et al. | |
| 2002/0193065 | A1 * | 12/2002 | Morris | E04D 13/176 454/365 |
| 2005/0126088 | A1 | 6/2005 | Rotter | |
| 2005/0136831 | A1 | 6/2005 | Coulton | |
| 2006/0019598 | A1 | 1/2006 | Rotter | |
| 2006/0079173 | A1 | 4/2006 | Coulton et al. | |
| 2006/0154597 | A1 | 7/2006 | Coulton et al. | |
| 2007/0117505 | A1 | 5/2007 | Wey et al. | |
| 2008/0220714 | A1 | 9/2008 | Caruso et al. | |
| 2008/0318516 | A1 | 12/2008 | Rotter | |

OTHER PUBLICATIONS

Air Vent Ventilation Products, JB Supply Company, website print-out, 1 page, www.jbsupply.com/ctairvent.htm, Aug. 24, 2005.
Ridge Filter Shinglevent, Air Vent Inc., 4 pages.

* cited by examiner

MESH VENT WITH VARYING DENSITY OR INTEGRAL MOISTURE BARRIER

REFERENCE TO RELATED APPLICATION

Priority is hereby claimed to the filing date of U.S. provisional patent application No. 61/580,453 filed on 27 Dec. 2011.

TECHNICAL FIELD

This disclosure relates generally to ridge vents and more specifically to rollable mesh-type ridge vents formed of randomly aligned synthetic fibers joined with binding agents and cured to provide an air-permeable mat.

BACKGROUND

To ventilate an attic space, it is common to form a ridge slot in the roof deck extending along a ridge of the roof and to install a ridge vent over the ridge slot in conjunction with installation of soffit ventilation. The ridge vent permits heated air from the attic below to pass through the ridge slot and through the vent while preventing ingress of water, insects, and vermin into the attic. One common type of ridge vent is the so-called rollable mesh ridge vent. One rollable mesh ridge vent that has been commercially successful is the ridge vent and system disclosed in U.S. Pat. No. 5,167,579 of Rotter entitled Roof Vent of Synthetic Fiber Matting. This patent is hereby incorporated fully by reference. Generally, the Rotter ridge vent is a unitary sheet construction of randomly aligned synthetic fibers that are opened and blended, randomly aligned into a web by airflow, joined by phenolic or latex binding agents, and heat cured to produce an air-permeable mat with a substantially constant fiber density throughout. The vent is fabricated in substantial lengths and is rolled into a roll for storage and shipment. For installation, the vent is unrolled along a roof ridge covering a ridge slot and secured to the roof decking on either side of the slot. Ridge cap shingles are then installed atop the ridge vent to form a moisture barrier and to present a traditional appearance. Warm air from the attic below passes through the ridge slot, flows through the mesh mat of the ridge vent, and exits along the edges of the ridge vent to ambience.

While the Rotter ridge vent has proven successful, it nevertheless requires that a water sealed row of ridge cap shingles be carefully installed atop the vent to prevent leakage through the mat and into an attic below. There have been attempts to make mesh ridge vents with their own water barriers so that ridge cap shingles either are not required or careless installation of ridge cap shingles is less likely to result in a water leak. U.S. Pat. No. 7,422,520 of Coulton et al., for example, discloses a roof ridge vent having a covering and a method of installing a ridge vent. The. Coulton et al. ridge vent has a ventilation component comprising a mat of openwork fibers similar to the Rotter ridge vent and a waterproof membrane bonded directly to one side of the ventilation component. The Coulton et al. vent is shipped in spiral wound rolls and is rolled out along a roof ridge having an open ridge slot with the membrane facing up. The ridge vent can then be attached with fasteners to the roof deck with the membrane left exposed to provide a moisture barrier. Alternatively, ridge cap shingles can be applied over the membrane if desired. The Coulton et al. patent is hereby fully incorporated by reference.

A need exists for rollable mesh attic vents and ridge vents in particular that provide exceptional ventilation of an attic space below using less material than traditional mesh ridge vents and that can incorporate an substantially impervious water barrier to prevent rain water from passing through the thickness of the mat. It is to the provision of ridge vents that address these and other needs and that provides other advantages that the present invention is primarily directed.

SUMMARY

U.S. provisional patent application No. 61/580,453 to which priority is claimed above is hereby incorporated by reference in its entirety.

Briefly described, an attic vent and, in a preferred embodiment, an open weave rollable mesh ridge vent is formed of randomly aligned synthetic fibers joined with binding agents and cured to provide an air-permeable mat. A water barrier can be integrally formed with the mesh ridge vent to inhibit the migration of water and moisture through the mat material while preserving the ventilating properties of the ridge vent. In one embodiment, the integral barrier can be formed by glass fibers, a glass mat, an asphalt coating, or a web of waterproof material such as underlayment bonded to the mat. In another embodiment, the integral water barrier can be formed by a layer or strata of dense fibers formed in the mesh material of the ridge vent. The layer of dense fibers may be formed on the top surface of the mesh ridge vent or at an intermediate location between the top and bottom surfaces of the ridge vent. In one embodiment, the mesh ridge vent is stratified in density with a variable fiber density through the thickness of the mat. In yet another embodiment, ventilation is provided with less material than traditional mesh ridge vents. More specifically, the mesh mat of this embodiment is relatively denser and thicker along its edge portions and relatively less dense and thinner along its mid portion. Combinations of these configurations may be used. Further, the mat may be treated for ultraviolet (UV) protection, for inhibiting the growth of fungus, bacteria, and other organisms, and/or coated with a fire retardant material if desired.

Thus, a mesh ridge vent is disclosed that can provide ventilation comparable to that of traditional constant fiber density ridge vents with less material. The ridge vent may incorporate a moisture barrier that is truly integral to the mat and not merely bonded to one side of the matt with adhesive or other bonding agents. This provides manufacturing advantages, and also results in a mesh ridge vent in which the barriers are not subject to delamination or other deterioration over long periods of time. In the embodiment with more dense thicker edge portions and a less dense thinner mid portion, the density of the edge portions can be selected to support the force of a nail driven by a nail gun through the edge portions of the ridge vent. Thus, traditional nail gun adapters used to prevent crushing of the mesh can be eliminated. A water barrier may be formed on the surface of the ridge vent by spraying or rolling on a waterproof material or it may be formed by a layer or layers of higher density fibers within the mesh itself. These and other features, advantages, and benefits will be better understood by the skilled artisan upon review of the detailed description set forth below taken in conjunction with the accompanying drawing figures, which are briefly described as follows.

DETAILED DESCRIPTION

Figure 1:
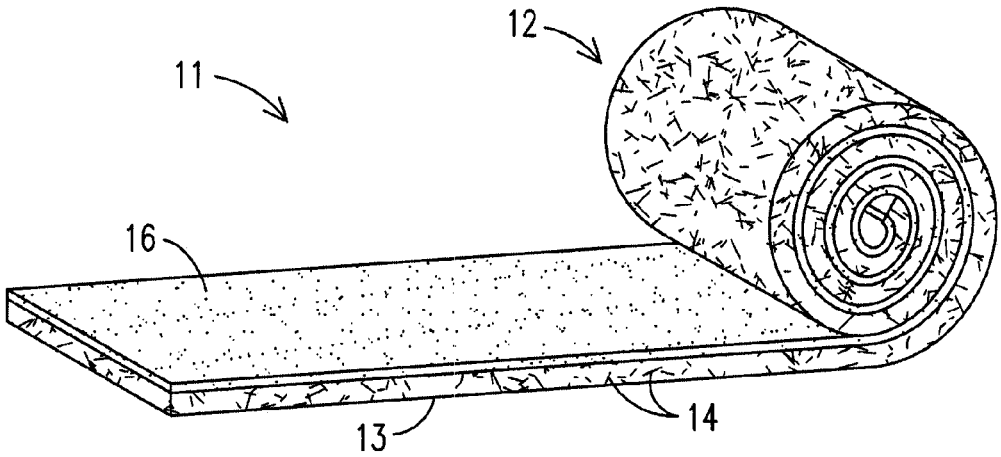
FIG. 1 is a perspective view of a mesh ridge vent according to one embodiment of the invention shown partially rolled into a roll.

Reference will now be made in more detail to the drawing figures, wherein like parts are identified with like reference numerals throughout the several views. FIG. 1 shows one embodiment of a mesh ridge vent according to the invention. The ridge vent 11 comprises a mat 13 of randomly aligned synthetic fibers 14 that are opened and blended, randomly aligned into a web by airflow, joined by phenolic or latex binding agents, and heat cured to produce an air-permeable mesh. The mat 13 may be of the type disclosed in the Rotter patent mentioned above. The mat is elongated and sufficiently flexible to be rolled into a roll 12 for storage and shipping. A moisture barrier 16 is an integral feature of the ridge vent 11 of this embodiment and, in the embodiment of FIG. 1, resides on the top or exposed surface of the ridge vent 11 as shown. The moisture barrier may be a coating of impermeable material such as asphalt sprayed, rolled, or otherwise deposited on the upper surface of the mat or a sheet of impermeable material fused or otherwise integrally bonded to the mat. The moisture barrier may be otherwise formed and otherwise located within the ridge vent as discussed in more detail below.

Figure 2:
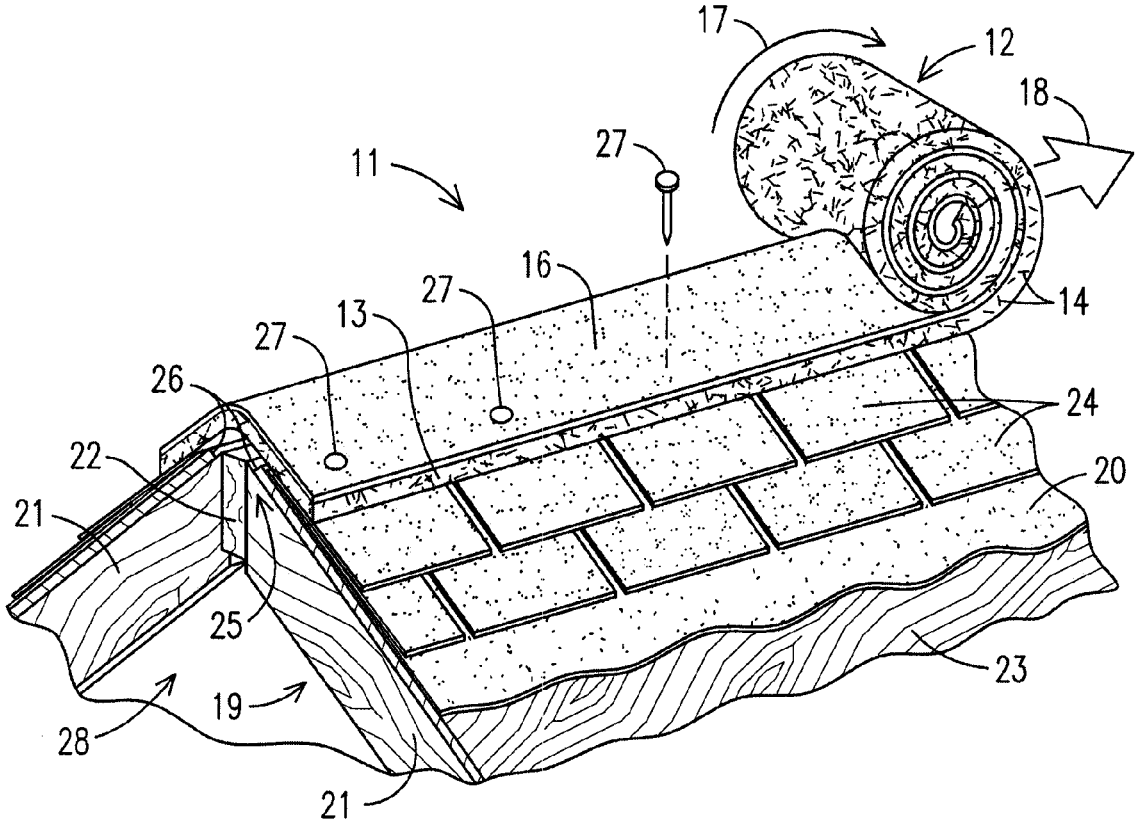
FIG. 2 is a perspective view of the mesh ridge vent of FIG. 1 being unrolled along a roof ridge having a ridge slot formed therealong.

FIG. 2 illustrates a method of installing the ridge vent 11 along the ridge of a roof 19 overlying a ridge slot 26 to provide attic ventilation. Generally, the roof 19 is formed of rafters 21 connected to and sloping downwardly from a ridge beam 22. Plywood or other decking material is secured to the rafters to form a roof deck 23 and the roof deck 23 is covered with an underlayment 20 and shingles 24. The roof 19 overlies and partially defines an attic space 28 below. The ridge vent 11 is installed in a similar manner to that of the Rotter patent by being rolled out as indicated by arrows 17 and 18 along the roof ridge 25 overlying and covering the ridge slot 26. As the ridge vent is deployed, it is fastened to the roof on either side of the ridge slot by appropriate fasteners 27, which may be nails driven with a nail gun. Traditionally, a nail gun adapter has been required when installing mesh ridge vent to prevent the nails from crushing the mesh when installed. In the illustrated embodiment, the moisture barrier may eliminate the need for a nail gun adapter by absorbing and spreading the force of the impact of the nail head.

When installed as described, hot air from the attic space 28 is free to flow through the open randomly aligned fibers 14 of the mesh mat 13 and escape to ambience through the opposed longitudinal edges of the mat. The integral moisture barrier 16, however, substantially prevents penetration of water from the top of the ridge vent. For example, rain water impinging on the ridge vent is prevented from penetrating to the mat below, from where it might otherwise leak through the ridge slot and into the attic space. Instead, the water is shed to the edges of the integral moisture barrier from where it drips onto the shingles 24 and flows down the roof in the normal manner. Ridge cap shingles can be applied over the installed mat if desired for aesthetic purposes, but this is not necessary and the ridge vent may simple be left uncovered. If ridge cap shingles are installed, the integral moisture barrier inhibits water that may leak through or between the ridge cap shingles from penetrating the ridge vent 11 and leaking into the attic space 28. The moisture barrier and/or the top of the mat may be shaped to resemble ridge cap shingles if desired for instances where ridge cap shingles are not to be used.

Figure 3:
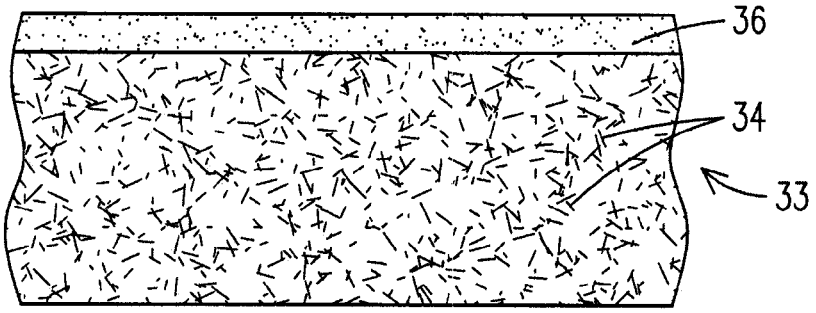
FIG. 3 is an edge view of a section of a mesh ridge vent according to another embodiment wherein an impervious coating is applied to the outer surface of the mat.

FIG. 3 is an edge view of another embodiment of the mesh ridge vent of this invention. This embodiment comprises a mat 33 formed of randomly aligned synthetic fibers 34 that are opened and blended, randomly aligned into a web by airflow, joined by phenolic or latex binding agents, and heat cured to produce an air-permeable mesh. Alternatively, other non-woven open mesh materials or any material with appropriate crush resistance and air permeability may be substituted with equivalent results such that the invention is not limited to the particular mat configuration of the preferred embodiment. For example, the mat may be made of recycled materials, natural materials, glass fibers, or co-fibers; i.e. fibers having a core material different from the outer material of the fibers.

A moisture barrier 36 is integrally formed with the mesh mat and, in this embodiment is disposed at the upper surface of the mat; that is, the surface that is to be exposed when the ridge vent is installed. The moisture barrier 36 may be a polymeric material that is applied by spraying, rolling, or by other application techniques in a wet form and allowed to cure after penetrating a short distance into the upper surface of the underlying mat. Once cured, the moisture barrier 36 becomes an integral element of the mesh ridge vent and, when the vent is installed, prevents the penetration of water into the mat below. This represents an improvement over simply attaching a sheet of material to the top of the mat with adhesive or other bonding agents because, among other reasons, adhesives and bonding agents can fail over long periods of time and the sheet can delaminate from the mesh mat. The moisture barrier 36 also can be a glass mat bonded to the mesh material, a peel and stick underlayment type material, an asphalt coating, or any other structure that forms a barrier to inhibit water from seeping through the mat.

Figure 4:
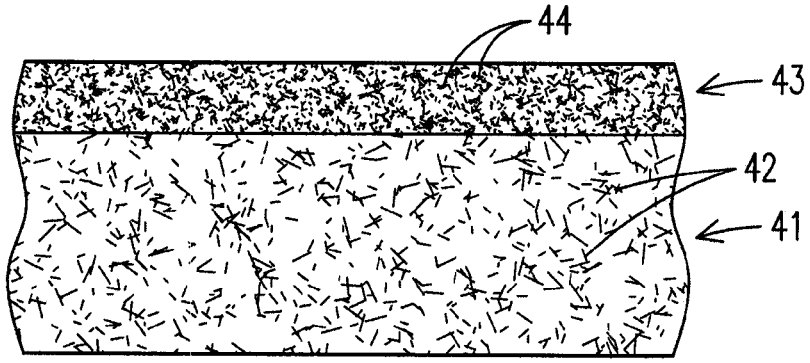
FIG. 4 is an edge view of a section of a mesh ridge vent according to another embodiment wherein a dense layer of mat fibers is formed along the outer surface of the mat.

FIG. 4 is an edge view of another embodiment of a ridge vent according to the invention. A mesh mat 41 preferably comprises randomly aligned synthetic fibers 43 that are opened and blended, randomly aligned into a web by airflow, joined by phenolic or latex binding agents, and heat cured to produce an air-permeable mesh. Other air permeable mat material may be used. A layer of the mat 44 at the upper surface thereof is densified to a sufficient density so that the layer becomes virtually impermeable (at least within the requirements of stringent building codes) to moisture and thus the more dense fibrous layer forms an integral moisture barrier at the top of the ridge vent. Accordingly, attic air can permeate and escape through the less dense lower layer of the mat 41 while moisture such as rainwater is substantially prevented from penetrating into the mat 41 by the moisture barrier formed by the layer 43 of dense fibers at the upper surface of the ridge vent. As with the prior embodiment, the ridge vent of this embodiment may be covered with ridge cap shingles, or may be left uncovered since the moisture barrier prevents ingress of water into the attic space below. The more dense layer of fibers also may eliminate the need for nail gun adapters by absorbing the impact of nail heads driven through the mat by pneumatic nail guns.

The fibers at the top surface of the mat may be rendered sufficiently dense in a number of ways such as by needling or blowing techniques applied during manufacture and/or by increasing the amount of phenolic or latex binding agents in this region to fill the spaces between the fibers. Other techniques may be applied and the invention is not limited to any particular technique for densifying layers within the ridge vent.

Figure 5:
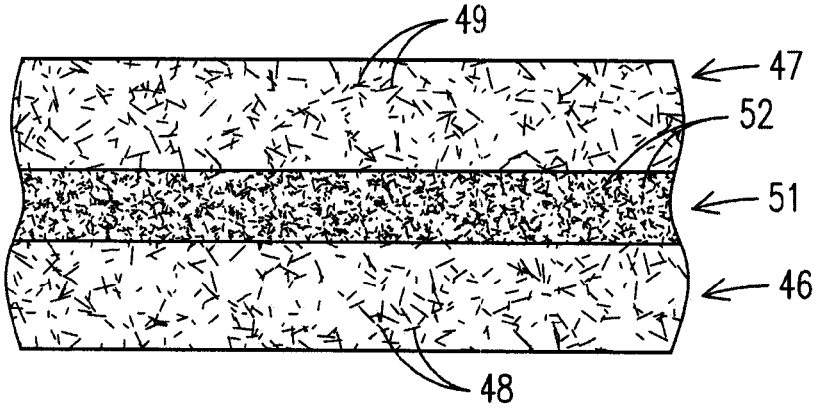
FIG. 5 is an edge view of a section of a mesh ridge vent according to yet another embodiment wherein a dense layer of mat fibers is formed between the inner and outer surfaces of the mat.

FIG. 5 is an edge view of a ridge vent according to another embodiment of the invention. This embodiment is similar to that of FIG. 4 in that the moisture barrier is formed by a layer or strata of densified fibers that is sufficiently dense to form a moisture barrier. In this embodiment, however, the layer of dense fibers 52 is disposed between the upper surface 47 and the lower surface 46 of the ridge vent. Air permeable layers 49 and 48 are thus disposed both above and below the dense layer. Water may penetrate the upper fibers but is stopped and diverted by the moisture barrier layer below. Techniques for forming the dense layer sandwiched between layers of open mesh material include, but are not limited to needling or blowing techniques applied during manufacture and/or by increasing the amount of phenolic or latex binding agents in this region to fill the spaces between the fibers. Other techniques may be applied and the invention is not limited to any particular technique for densifying layers within the ridge vent.

Figure 6:
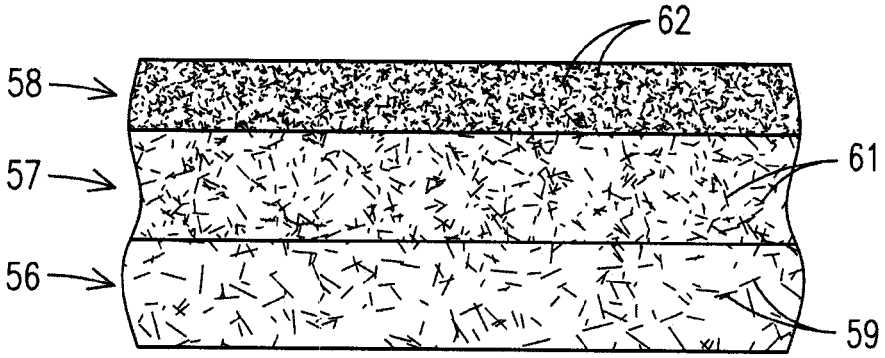
FIG. 6 is an edge view of a section of a mesh ridge vent according to still another embodiment wherein the fiber density varies through the thickness of the mat.

FIG. 6 is an edge view of a ridge vent demonstrating yet another embodiment of the invention. In this embodiment, the density of the ridge vent mat varies through its thickness. Specifically, a lower layer 56 preferably is formed of randomly aligned synthetic fibers that are opened and blended, randomly aligned into a web by airflow, joined by phenolic or latex binding agents, and heat cured to produce an air-permeable mesh. This layer allows attic air to pass and exit through the edges of the layer. An intermediate layer 57 comprises fibers that that are densified through needling, blowing, or other techniques to an intermediate density that may not form a complete moisture barrier but may resist the free flow of air through the layer. Finally, an upper layer 58 is formed by fibers that have been densified to a sufficient density to form a moisture barrier that is integral with the ridge vent. The stratified fiber density illustrated in FIG. 6 can be formed by the techniques mentioned above or by other appropriate techniques.

In addition to forming an integral moisture barrier, the coating 36 and/or the densified layers 43, 51, and 62 preferably incorporate UV inhibiting or blocking agents to protect the mat from deterioration by the sun's UV radiation. They may also contain antifungal, antibiotic, and/or pesticide agents to provide for protection against the growth of fungus, bacteria, or other organisms on or within the ridge vent and/or a fire retardant coating. Such protections are particularly useful when the ridge vent is to be installed without ridge cap shingles. Further, the upper surface of the mat and/or the moisture barrier at the top surface of the ridge vent, be it a coating or densified fibers, may be contoured or otherwise configured to mimic the look of overlapping ridge cap shingles or to accommodate surface or roof deck profiles. The barrier can be formed in various colors to match or complement the roofing shingles to be applied to a roof. In this way, the ridge vent may be left uncovered with ridge cap shingles yet still appear as though ridge cap shingles were applied.

Figure 7:
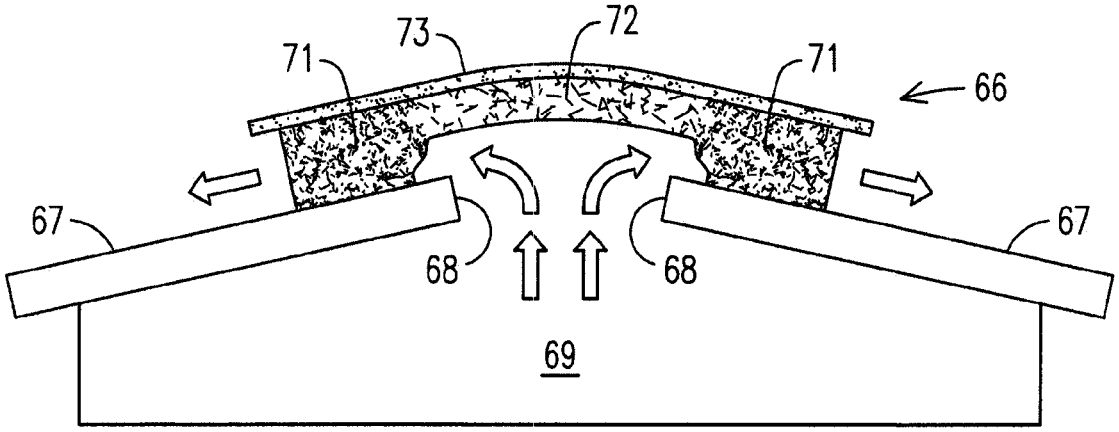
FIG. 7 is an end view of a mesh ridge vent having a barrier that resists penetration of water combined with thicker more dense edge portions and a thinner less dense central portion.

FIG. 7 illustrates yet another embodiment of the invention wherein fiber density variations are formed transversely across the width of the mat. The ridge vent 66 of this embodiment is installed on the ridge of a roof 67 covering a ridge slot 68 through which hot air may escape from an attic space 69 below the roof. The ridge vent 66 comprises a mat of randomly aligned synthetic fibers that are opened and blended, randomly aligned into a web by airflow, joined by phenolic or latex binding agents, and heat cured to produce an air-permeable mesh. The mat comprises edge portions 71 extending along the outside edges of the mat and a central portion 72 overlying the ridge slot 68. The central portion 72 in this embodiment is thinner than the edge portions 71 as illustrated. Furthermore, the fiber density in the edge portions 71 is greater than the fiber density in the central portion 72. As with previous embodiments, this fiber density difference, as well as the thickness difference, may be formed during manufacture by needling or blowing techniques and/or by increasing the amount of phenolic or latex binding agents in this region to fill the spaces between the fibers. Other techniques may be applied and the invention is not limited to any particular technique for densifying layers within the ridge vent. An impermeable coating or layer of densified fibers 73 may be applied to the top surface of the mat as described above to inhibit water penetration.

As illustrated by the arrows in FIG. 7, hot air from the attic space 69 flows by convection through the ridge slot 68 and beneath the thinner and less dense central portion of the mat. It then is free to flow through the edge portions 71 of the mat to ambience, thereby ventilating the attic space 69. It has been found that, although the more dense edge portions 71 may be less permeable owing to there density, air nevertheless flows through these regions acceptably well because the air does not have to pass through as much material as it does with a traditional constant density mesh ridge vent. The more dense edge portions have been found to provide additional benefits as well. For example, it has been found that they are less prone to crushing when a nail is driven through them with a nail gun. Accordingly, traditional nail gun adapters used in the past to prevent crushing need not be used during installation. This is important to roofers and installers since no special equipment need be used during installation. Furthermore, the increased fiber density in the edge portions has proven to be a significant deterrent to wind driven rain passing through the edge portions and into the attic space below. In fact, the ridge vent of this embodiment may well meet strict Dade Count Building Codes for moisture penetration. By selecting the proper density in the edge portions, a balance can be struck between air permeability and resistance to moisture penetration, resulting in a superior ridge vent product.

Figure 8:
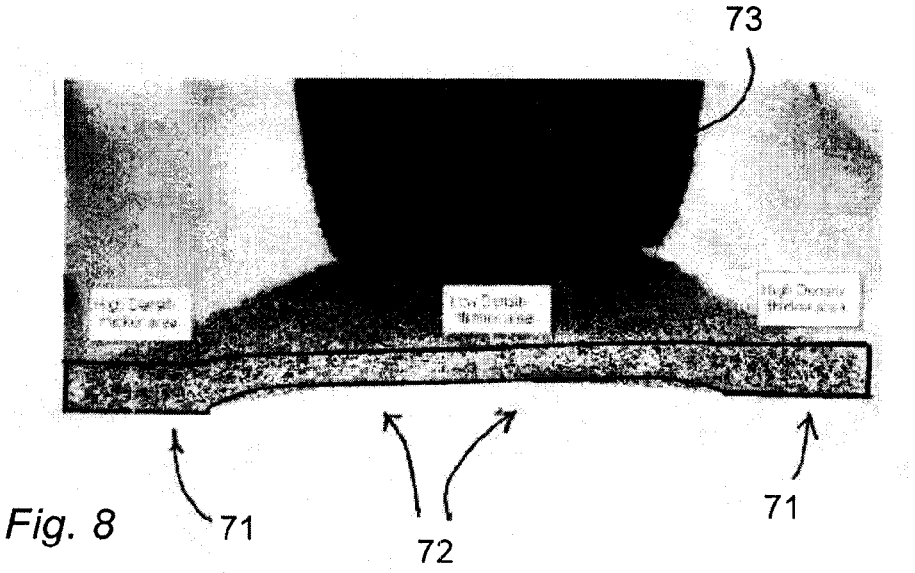
FIG. 8 is a photograph of a ridge vent that embodies the principles illustrated in FIG. 7.

FIG. 8 is a photograph of a ridge vent according to the embodiment of FIG. 7. The edge portions 71 are seen to be thicker than the central portion 72, and the edge portions are also denser than the central portion. A moisture barrier 73 is shown peeled back off of the fiber mat, and may be of any of the types of moisture barriers discussed above. Traditional fiber mat ridge vents generally have a substantially constant fiber density throughout. It has been found that for the ridge vent shown in FIGS. 7 and 8, a fiber density in the edge portions of the mat of up to about three times the fiber density in the central portion of the mat provides ventilation comparable to traditional fiber mat ridge vents while offering the additional advantages of crush resistance and moisture barrier properties. In one specific example, a fiber density in the central region of the mat between about 8.1 and 9.1 ounces per square yard with a fiber density in the edge portions of the mat between about 12.2 and 13.6 ounces per square yard proved to be an acceptable combination. However, the invention is not limited to these specific ratios of fiber density.

The invention has been described herein in terms of preferred embodiments and methodologies considered by the inventors to represent the best modes of carrying out the invention. It will be understood by the skilled artisan, however, that a wide range of additions, deletions, and modifications, both subtle and gross, may well be made to the illustrated and exemplary embodiments without departing from the spirit and scope of the invention as delineated only by the claims. For instance, the identified density ranges above are not limiting and other densities in various regions outside these ranges are within the scope of the invention. It is not a requirement of the invention that a moisture barrier be incorporated at all and embodiments are possible with varying densities that do require ridge cap shingles to provide a moisture barrier. Other innovations such as embedded wiring for fans and other ancillary ventilating equipment may well be incorporated into the fiber mesh. Also the top layer can be made of a fire retardant material in addition to being UV and fungus resistant. The moisture barrier can be a peel-and-stick sheet applied to the mesh or plastic part modules integrated with the web. The top layer also can be provided with photovoltaic collectors or solar cells for generation of solar power, which can be transmitted through wires embedded in the ridge vent. These and other modifications should be construed to be within the scope of the invention disclosed herein.

What is claimed is:

1. A ridge vent comprising a unitary mat of fibrous material having a top surface, edge portions having bottom surfaces adapted to contact a roof adjacent a ridge of the roof, and a central portion between the edge portions, the mat having a lower layer to face downwardly when the ridge vent is installed along the ridge of the roof, the lower layer formed of fibers and being air permeable to allow attic air to flow through the lower layer, and an upper layer different than the lower layer and disposed above the lower layer between the top surface and the bottom surfaces of the mat, the upper layer being integrally formed with the lower layer and comprising fibers that are sufficiently dense to inhibit the penetration of moisture through the upper layer such that the upper layer forms a moisture barrier.

2. The ridge vent of claim 1 and wherein the layer of dense fibers is disposed at the top surface of the mat.

3. The ridge vent of claim 1 and wherein the layer of dense fibers is spaced below the top surface of the mat.

4. The ridge vent of claim 1 wherein the densities of the fibers varies through the thickness of the ridge vent.

5. The ridge vent of claim 1 wherein a top surface of the ridge vent is configured to mimic the look of ridge cap shingles.

6. A ridge vent for installation along a roof ridge covering a ridge slot therein, the ridge vent comprising a single unitary mat of randomly aligned synthetic fibers joined by binding agents and having a top surface, edge portions having bottom surfaces adapted to contact the roof adjacent the roof ridge, and a central portion between the side edge portions, a fiber density in the edge portions of the mat being greater than a fiber density in the central portion of the mat to form moisture barriers between the central portion of the mat and ambience that are resistant to water penetration.

7. The ridge vent of claim 6 and wherein the edge portions between the top surface and the bottom surfaces of the mat are thicker than the central portion of the mat.

8. The ridge vent of claim 6 further comprising a moisture barrier disposed at the top surface and extending downward into the fibers of the mat.

9. The ridge vent of claim 8 wherein the moisture barrier comprises a layer of the fibers defining the top surface of the ridge vent that is more dense than the edge portions and the central portion of the mat.

10. The ridge vent of claim 8 wherein the edge portions between the top surface and the bottom surfaces of the mat are thicker than the central portion of the mat.

11. The ridge vent of claim 6 wherein the fiber density in the edge portions of the mat is between 1 and 3 times the fiber density in the central portion of the ridge vent.

* * * * *